US011793270B2

(12) United States Patent
Buck

(10) Patent No.: US 11,793,270 B2
(45) Date of Patent: Oct. 24, 2023

(54) SHOES AND SOLE SPRINGS FOR SHOES

(71) Applicant: Versi LLC, Sheridan, WY (US)

(72) Inventor: Daniel C. Buck, Chicago, IL (US)

(73) Assignee: Versi LLC, Sheridan, WY (US)

( * ) Notice: Subject to any disclaimer, the term of this patent is extended or adjusted under 35 U.S.C. 154(b) by 0 days.

(21) Appl. No.: 16/911,973

(22) Filed: Jun. 25, 2020

(65) Prior Publication Data

US 2021/0015209 A1 Jan. 21, 2021

Related U.S. Application Data

(60) Provisional application No. 62/876,397, filed on Jul. 19, 2019.

(51) Int. Cl.
*A43B 13/18* (2006.01)

(52) U.S. Cl.
CPC ..... *A43B 13/183* (2013.01); *A43B 13/181* (2013.01)

(58) Field of Classification Search
CPC ..... A43B 13/183; A43B 13/184
See application file for complete search history.

(56) References Cited

U.S. PATENT DOCUMENTS 4,492,046 A 1/1985 Kosova
4,566,206 A 1/1986 Weber
4,910,884 A * 3/1990 Lindh ..... A43B 13/18 36/27
5,435,079 A 7/1995 Gallegos
5,875,567 A * 3/1999 Bayley ..... A43B 13/18 36/27
6,029,374 A 2/2000 Herr et al.
6,928,756 B1 8/2005 Haynes
7,334,351 B2 * 2/2008 Hann ..... A43B 13/206 36/27
7,752,695 B2 7/2010 Kaufman et al.
7,779,558 B2 * 8/2010 Nishiwaki ..... A43B 13/206 36/27
8,112,905 B2 2/2012 Bemis et al.
8,959,797 B2 2/2015 Lyden
9,107,476 B2 * 8/2015 Kruglov ..... A43B 13/183
9,332,805 B2 * 5/2016 Baum ..... A43B 13/183
9,357,813 B2 6/2016 Lyden
9,480,303 B2 11/2016 Barnes et al.
9,907,356 B2 3/2018 Baum et al.
10,441,021 B1 10/2019 Polk
2006/0174515 A1 * 8/2006 Wilkinson ..... A43B 13/183 36/27

(Continued)

OTHER PUBLICATIONS

Backermann, U.S. Pat. No. 898,084, published Sep. 8, 1908.

*Primary Examiner* — Katharine G Kane
(74) *Attorney, Agent, or Firm* — Andrus Intellectual Property Law, LLP

(57) ABSTRACT

A shoe has a shoe upper configured to receive a foot of a user, a sole coupled the shoe upper and having a cavity, and a sole spring in the cavity. The sole spring has a first leg and an opposite second leg, and the sole spring is removably positioned in the cavity. Accordingly, when the user presses the shoe into contact with a support surface, the first leg and the second leg flex toward each other thereby cushioning the foot of the user, and when the user moves the shoe away from the support surface the first leg and the second flex away from each other thereby propelling the user away from the support surface.

14 Claims, 15 Drawing Sheets

(56) References Cited

U.S. PATENT DOCUMENTS

| | | | | |
|---|---|---|---|---|
| 2007/0271818 | A1* | 11/2007 | Rabushka | A43B 13/181 36/38 |
| 2012/0246969 | A1* | 10/2012 | Baum | A43B 13/37 36/27 |
| 2012/0285040 | A1* | 11/2012 | Sievers | A43B 13/183 36/27 |
| 2013/0192090 | A1* | 8/2013 | Smith, IV | A43B 13/182 36/103 |
| 2014/0173931 | A1* | 6/2014 | Kruglov | A43B 13/183 36/27 |
| 2014/0259785 | A1* | 9/2014 | Lester | A43B 13/185 36/102 |
| 2015/0027000 | A1* | 1/2015 | Barnes | A43B 13/183 36/87 |

* cited by examiner

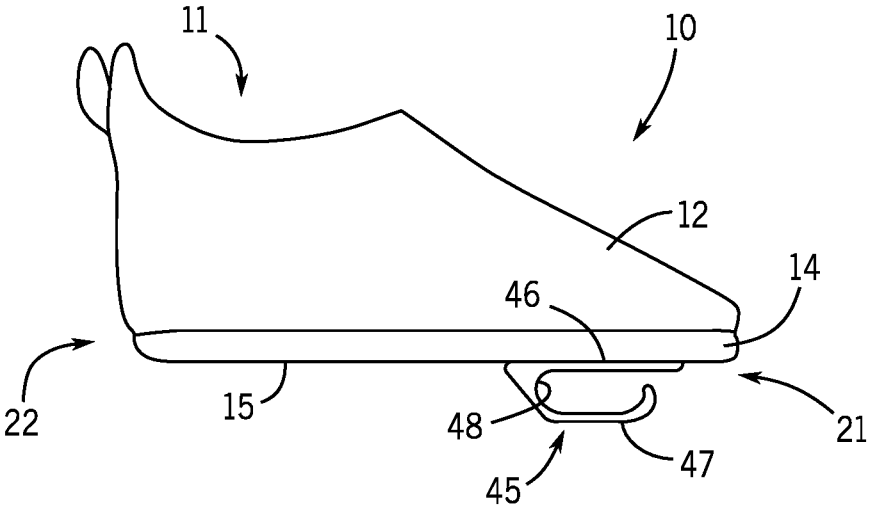
FIG. 14
FIG. 15
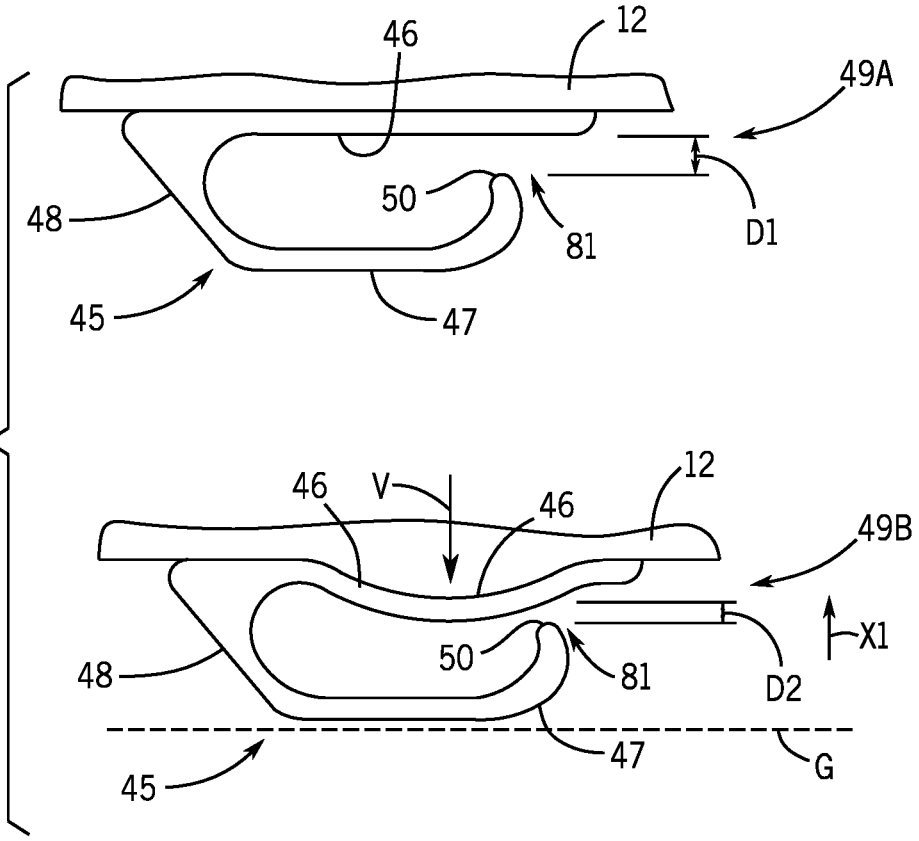

SHOES AND SOLE SPRINGS FOR SHOES

CROSS-REFERENCE TO RELATED APPLICATION

The present disclosure is based on and claims priority to U.S. Provisional Patent Application No. 62/876,397 filed Jul. 19, 2019, the disclosure of which is incorporated herein by reference.

FIELD

The present disclosure relates to shoes, and specifically shoes adapted for storing, transferring, and restoring energy as a person uses the shoes.

BACKGROUND

Shoes are manufactured in various types and styles such as athletic sneakers, sandals, dress shoes, casual shoes, medical shoes, and the like. Several considerations, such as foot protection, user comfort, and style, influence the design of the shoes. During use, shoes protect and cushion the feet of the user from shock forces generated when the user moves the shoes into contact with the ground.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a shoe has a shoe upper configured to receive a foot of a user, a sole coupled the shoe upper and having a cavity, and a sole spring in the cavity. The sole spring has a first leg and an opposite second leg, and the sole spring is removably positioned in the cavity. Accordingly, when the user presses the shoe into contact with a support surface, the first leg and the second leg flex toward each other thereby cushioning the foot of the user, and when the user moves the shoe away from the support surface the first leg and the second flex away from each other thereby propelling the user away from the support surface.

An example of a shoe extends from a heel end to a toe end. The shoe includes an upper configured to receive a foot of a user. A sole includes an insole connected to the upper and an outsole configured for contact with a support surface. The sole extends from the heel end to the toe end. A plurality of sole springs are located in the sole between the insole and the outsole. Each sole spring of the plurality of sole springs include at least a first leg and a second leg The first leg and the second leg are connected by a spring end. The plurality of sole springs include a heel sole spring located at the heel end, a toe sole spring located at the toe end, and a middle sole spring located between the heel end and the toe end. When the user presses the shoe into contact with the support surface the plurality of sole springs store energy therein with relative movement of the first leg towards the second leg. When the user moves the shoe away from the support surface the plurality of sole springs release the stored energy by relative movement of the first leg away from the second leg.

In further examples of the shoe, a midsole extends between the insole and the outsole and the plurality of sole springs are located in the midsole. The sole may extend from the heel end to the toe end in a longitudinal dimension defining a length of the sole and may extend in a lateral dimension perpendicular to the longitudinal dimension defining a width of the sole. The middle sole spring tapers the longitudinal dimension from medial side of the sole to a lateral side of the sole in the lateral dimension. A portion of the midsole extends exterior of at least one sole spring of the plurality of sole springs in the lateral dimension. A portion of the midsole extends exterior of the plurality of sole springs in the lateral direction. A shroud extends exterior of the plurality of sole springs in the lateral direction. The middle sole spring further includes a second spring end opposite the first spring end and further connecting the first leg and the second leg of the middle sole spring. The heel sole spring and the toe sole spring each further include second spring ends connecting the respective first legs and second legs of the respective heel sole spring and toe sole spring. The spring end of the heel sole spring is located at a side of the heel sole spring proximate the toe end of the sole and the spring end of the toe sole spring is located at a side of the toe sole spring proximate the heel end of the sole. The toe sole spring is open towards the toe end of the sole and the heel sole spring is open towards the heel end of the sole. At least one sole spring of the plurality of sole springs may be removable from the sole. The sole may include a heel cavity, a toe cavity, and a middle cavity located between heel cavity and the toe cavity located between the insole and the outsole. The heel sole spring, toe sole spring, and the middle sole spring are configured to be removably secured within the respective heel cavity, toe cavity, and middle cavity.

An example of a shoe extends from a heel end to a toe end. An upper configured to receive a foot of a user. A sole includes an insole connected to the upper and an outsole configured for contact with a support surface. The sole extends from the heel end to the toe end. A sole spring includes a first leg and a second leg opposite the first leg, the first and second legs connected by a spring end. When the user presses the shoe into contact with the support surface the sole spring stores energy therein with relative movement of the first leg towards the second leg. When the user moves the shoe away from the support surface the sole spring release the stored energy by relative movement of the first leg away from the second leg.

In further examples of the shoe a cavity is defined within the sole between the insole and the outsole. The sole spring is removably positioned within the cavity. The first leg and the second leg extend parallel to each other. The sole includes a midsole between the insole and the outsole, wherein the cavity is formed into the midsole. A keyway extends from the cavity into the midsole. A key member extends from the spring end of the sole spring. The key member is configured for releasable engagement with the keyway to secure the sole spring within the cavity. A recess is defined into the midsole. A tab extends from the key member. The tab is resiliently received within the recess to prevent lateral movement of the key member in the keyway.

The sole spring may be one of a plurality of sole springs each located in the sole between the insole and the outsole. Each sole spring of the plurality of sole springs includes at least the first leg and the second leg, the first leg and the second leg connected by the spring end. The plurality of sole springs include a heel sole spring located at the heel end, a toe sole spring located at the toe end, and a middle sole spring located between the heel end and the toe end.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

FIG. 14 is a side view of another exemplary shoe.

FIG. 15 are side views of an exemplary embodiment of a sole spring on the shoe depicted in FIG. 14.

DETAILED DESCRIPTION

Shoes, such as sneakers, sandals, dress shoes, casual shoes, medical shoes, and boots, often includes a lower portion or shoe sole that is typically formed from resilient and/or compressible materials, such as foam and rubber. Over time and after continued use of the shoes, the sole can deteriorate as a result of shock forces from each step transferring through the sole to the foot of the user. The present inventor recognized that three parts of the foot are often significantly impacted by these forces as a person uses the use. That is, when a person uses the shoe (e.g., the user walks), the tarsus or heel bone structure (heel), the metatargal bone cluster or the metatarsalsi phalanges (ball of the foot), and the toe absorb most of the energy generated during use. A typical gait pattern includes a heel strike, loading/stance, toe off, and swing phases. During this sequence, energy transfers through these portions of the foot to bone-muscle tendons and ligaments. Over time these tendons and ligaments debilitate which may lead to medical problems and/or cause pain when the person walks. Thus, there is a need to efficiently transfer and disperse energy through the shoes and to the foot of the person. Through research and experimentation, the present inventor has endeavored to develop shoes, and features thereof, that can store energy, transfer energy, and aid in user movement. Furthermore, the present inventor endeavored to develop shoes and shoe soles that retain the original shape and have shock absorption properties even after prolonged and extended use. Accordingly, the present inventor has developed the shoes and shoe components of the present disclosure that are described herein below.

Figure 1:
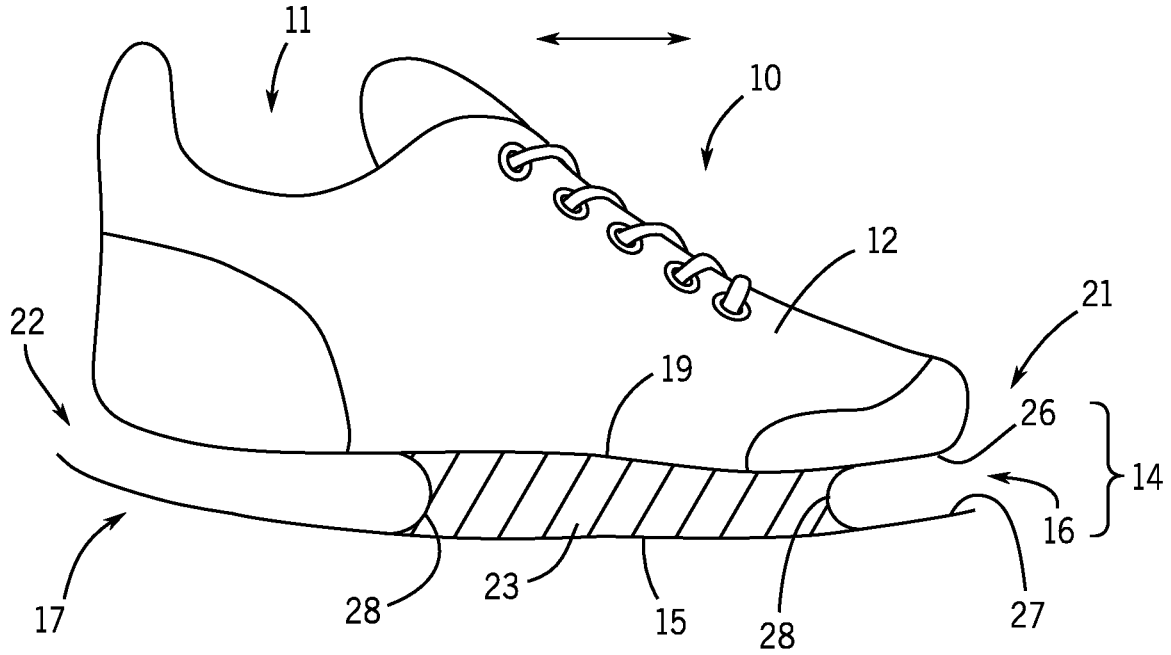
FIG. 1 is a side view of an exemplary shoe according to the present disclosure.

FIG. 1 depicts an exemplary shoe 10 of the present disclosure. The shoe 10 has a shoe upper 12 that defines a shoe opening 11 through which a user places their foot into the shoe upper 12 (see also FIG. 7). A sole 14 is connected to the shoe upper 12, and the sole 14 has an exterior surface or outsole 15 that contacts a support surface (e.g., the ground) as the user uses the shoe 10. The sole 14 further includes a midsole 23 that connects the outsole 15 to an insole 19 upon which the foot rests. The midsole 23 is exemplarily constructed of a resilient and compressible material.

Figure 2:
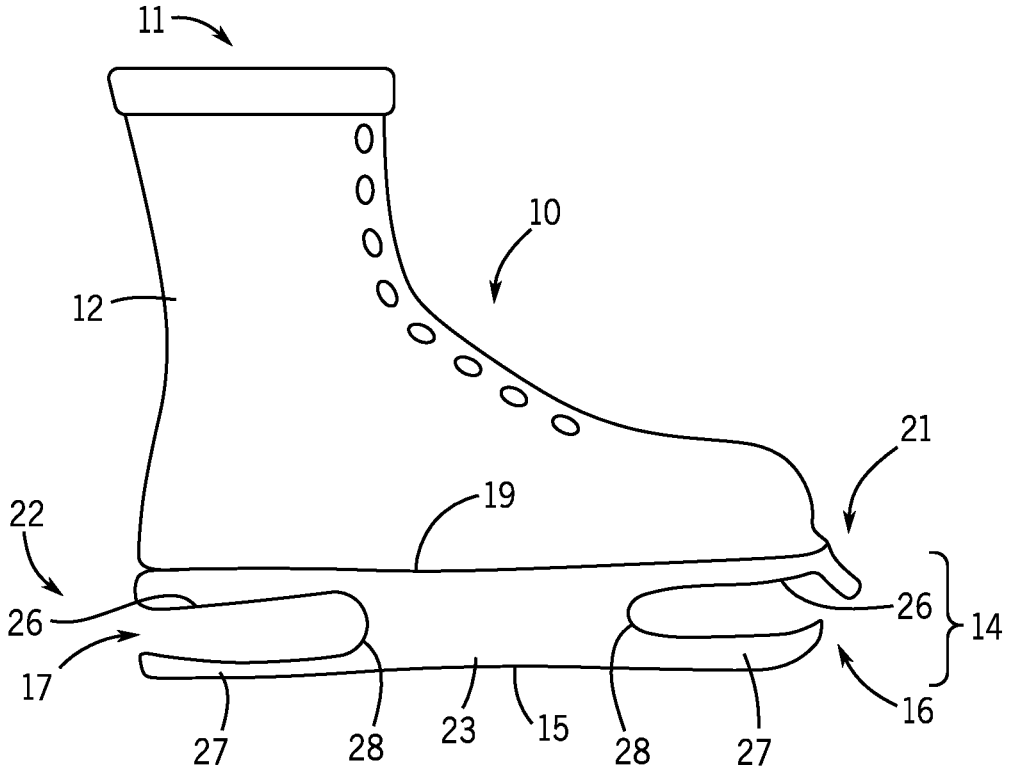
FIG. 2 is a side view of another exemplary shoe.
Figure 23:
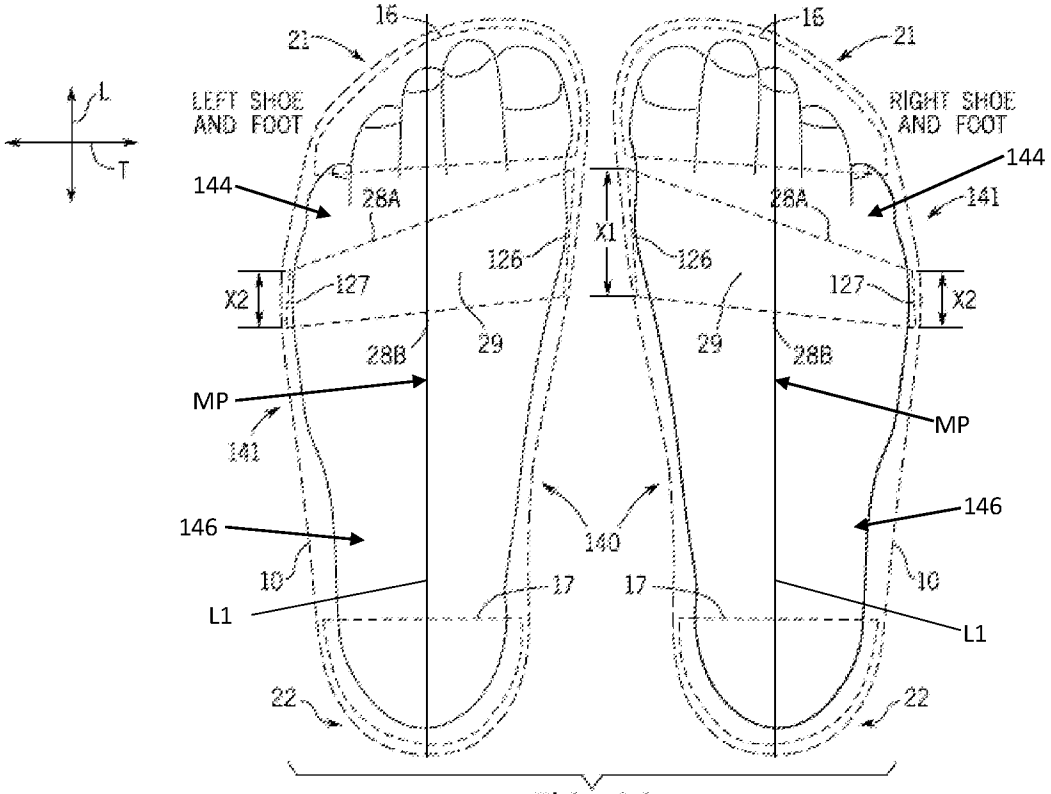
FIGS. 23-24 are views of another exemplary shoe.

The shoe 10 and the sole 14 extend along a longitudinal dimension (see arrow L on FIG. 23) between a toe end 21 and an opposite heel end 22 and a lateral dimension (see arrow T on FIG. 23) between a first side 140 (see FIG. 23; e.g., interior side of the shoe 10) and an opposite second side 141 (see FIG. 23; e.g., exterior side of the shoe 10). The sole 14 further includes one or more resilient sole springs 16, 17 that absorb and transfer energy when the shoe 10 is worn by the user. The shoe 10 depicted in FIG. 1 has a front resilient sole spring 16 at the toe end 21 and a rear resilient sole spring 17 at the heel end 22. The midsole 23 extends between the sole springs 16, 17. As will be described in greater detail below, the sole springs 16, 17 resiliently or elastically deform and/or flex as the shoe 10 is used to thereby provide cushioning and to store this naturally generated energy to release as a kinetic aid in the movement of the user (e.g., propel the user). The sole springs 16, 17 can be provided in a variety of different shoe styles. For example, FIG. 1 depicts the sole springs 16, 17 in the sole 14 of an athletic shoe and FIG. 2 depicts the sole springs 16, 17 in the sole 14 of a work boot. The sole springs 16, 17 are made from any suitable material such as carbon fiber, fiberglass, plastic, polycarbonate, rubber, metal, and any combination thereof (e.g., a material comprising plastic and carbon fiber).

In certain exemplary embodiments, the sole springs 16, 17 are formed with a suitable thickness and/or material that permits elastic deformation of the sole springs 16, 17 when the sole 14 contacts the ground. The sole springs 16, 17 are further formed to store energy (e.g., potential energy), transfer the energy, and/or return or restore the energy as a spring force that propels the user. The sole springs 16, 17 also provide cushioning and/or shock resistance benefits to the user, for example to cushion heel-strike forces. In certain exemplary embodiments, the outsole 15, midsole 23, insole 19 and/or the sole springs 16, 17 are structurally tuned to the size and/or weight of the user. That is, the specific construction of the sole 14 can be tailored to the weight of the user. Accordingly, a wide range of users will find the shoe 10 useful. In addition, elastic properties of the soles 14 can be varied to provide different advantages to the user (e.g., materials with more elastic materials are used in high-impact applications of the shoe 10).

Figure 3:
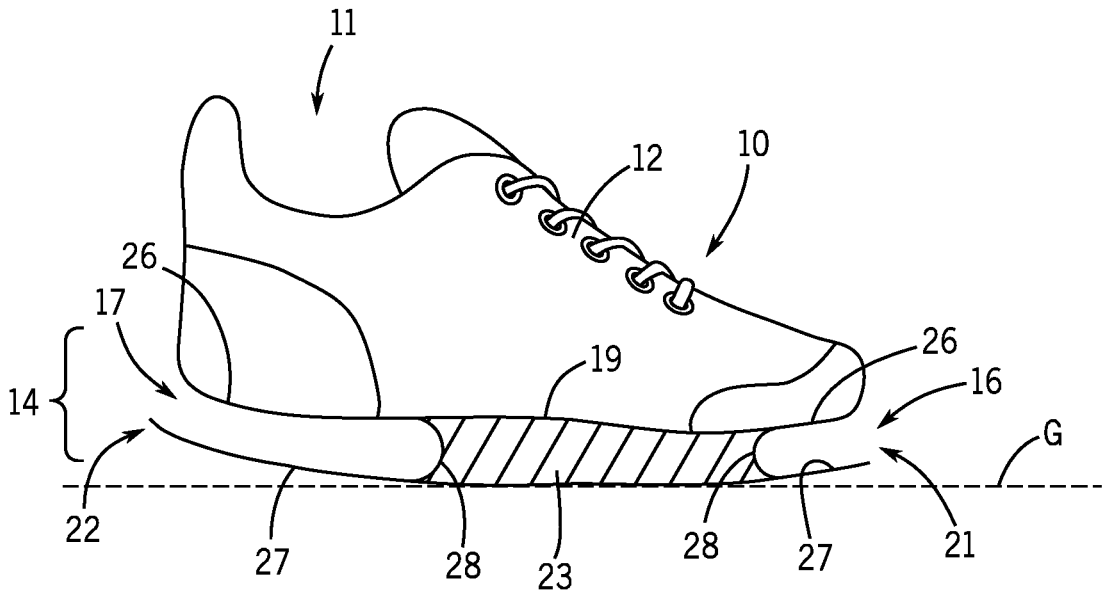
FIG. 3 is a side view of an exemplary shoe when a user of the shoe is standing still.
Figure 4:
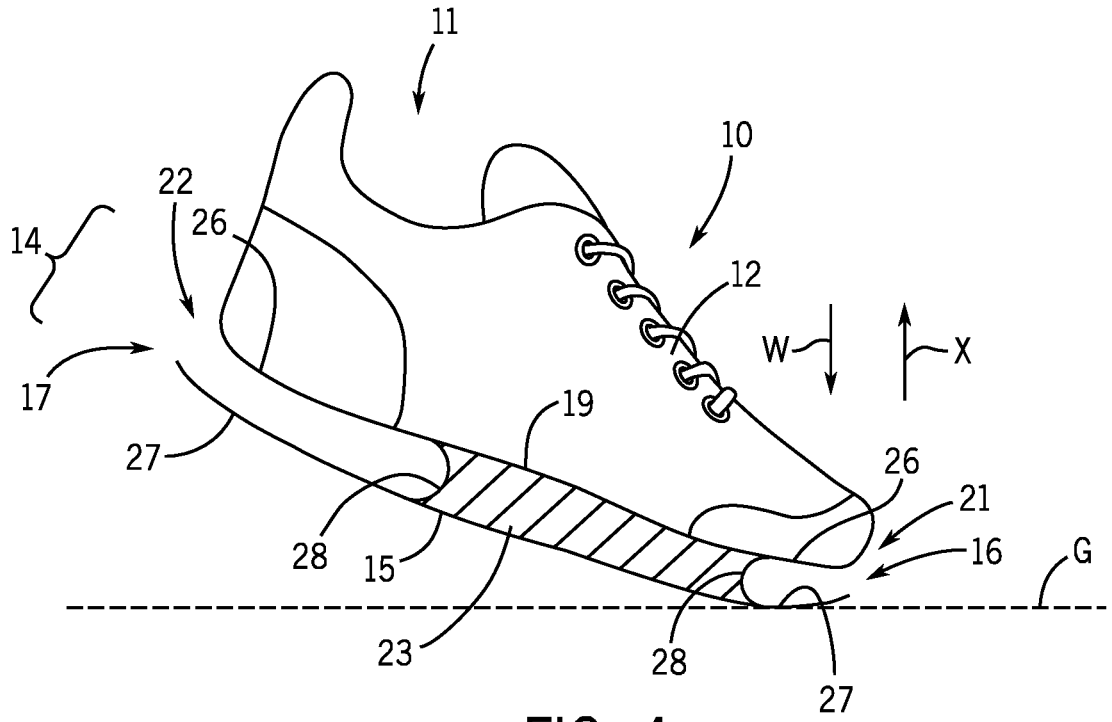
FIG. 4 is a side view of the shoe depicted in FIG. 3 when the user begins to walk forward.

FIGS. 3-4 depict an exemplary shoe 10 in different positions when in use. Specifically, FIG. 3 depicts the sole 14 contacting the ground G such that the sole springs 16, 17 are in uncompressed positions such as when the user is standing still. FIG. 4 depicts the shoe 10 as the user begins to move forward and lift the shoe 10 off the ground G. In this position, the heel end 22 is elevated above the ground G and the user places their weight toward the toe end 21. Accordingly, the front sole spring 16 deforms or compresses under the weight of the user. In particular, the front sole spring 16 has a lower leg 27 and an upper leg 26. The lower leg 27 and the upper leg 26 are connected by a spring end 28 and move or flex toward each other as the weight of the user (see arrow W) moves toward the toe end 21. The spring end 28 is exemplarily constructed as a "C" or curved shape connecting the lower leg to the upper leg, and forming two opposed cantilevered springs. As the legs 26, 27 move toward each other, the front sole spring 16 compresses (FIG. 4) thereby storing energy therein. The energy remains in the sole spring 16 until the user begins to lift their foot off the ground G such that the sole spring 16 begins to decompress (e.g., the legs 26, 27 move away from each other) and the energy stored in the sole spring 16 releases as a force (see arrow X in FIG. 4) directed away from the ground G. As such, the user experiences this force in the direction of movement, reducing the effort needed to lift the shoe 10 off the ground G. In further examples, the front sole spring 16 returns a greater portion of the force and thus these examples may be utilized to improve running and/or jumping.

The rear sole spring 17 produces a similar effect as the user moves the shoe 10 away from the ground G. However, the rear sole spring 17 provides a cushioning effect during heel strike. That is, as the heel strikes, the legs 26, 27 of the rear sole spring 17 move or flex toward each other under the weight of the user. As such the rear sole spring 17 compresses and stores energy (similar to the front sole spring 16 as described above.). As the user continues to move their weight toward the toe end 21, the rear sole spring 17 decompresses (e.g., the legs 26, 27 move away from each other) and the energy stored in the rear sole spring 17 releases as a force directed away from the ground G. This force provided by the sole spring 17 assists the user to transition from heel strike into the stance phase.

The exemplary soles 14 and/or sole springs 16, 17 described herein above with respect to FIGS. 1-4 can be implemented in various types of shoes 10. As previously noted, the front sole spring 16 may assist in athletic performance. Therefore, in one example, the front sole spring 16 positioned at the toe end 21 of a shoe intended for athletic uses (e.g., basketball, running). As previously noted, the rear sole spring 17 may assist in fatigue reduction. Therefore, in another example, the rear sole spring 17 positioned at the heel end 22 of a shoe intended for medical (e.g. orthotic) or working purposes. In this example, the shoes 10 may be useful for people performing jobs that require significant amounts of standing (e.g., assembly line workers, nurses). In another example, shoes 10 with sole springs 16, 17 at both the toe end 21 and the heel end 22, respectively, may provide a good, all-around shoe with benefits and advantages of both sole springs 16, 17.

Figure 5:
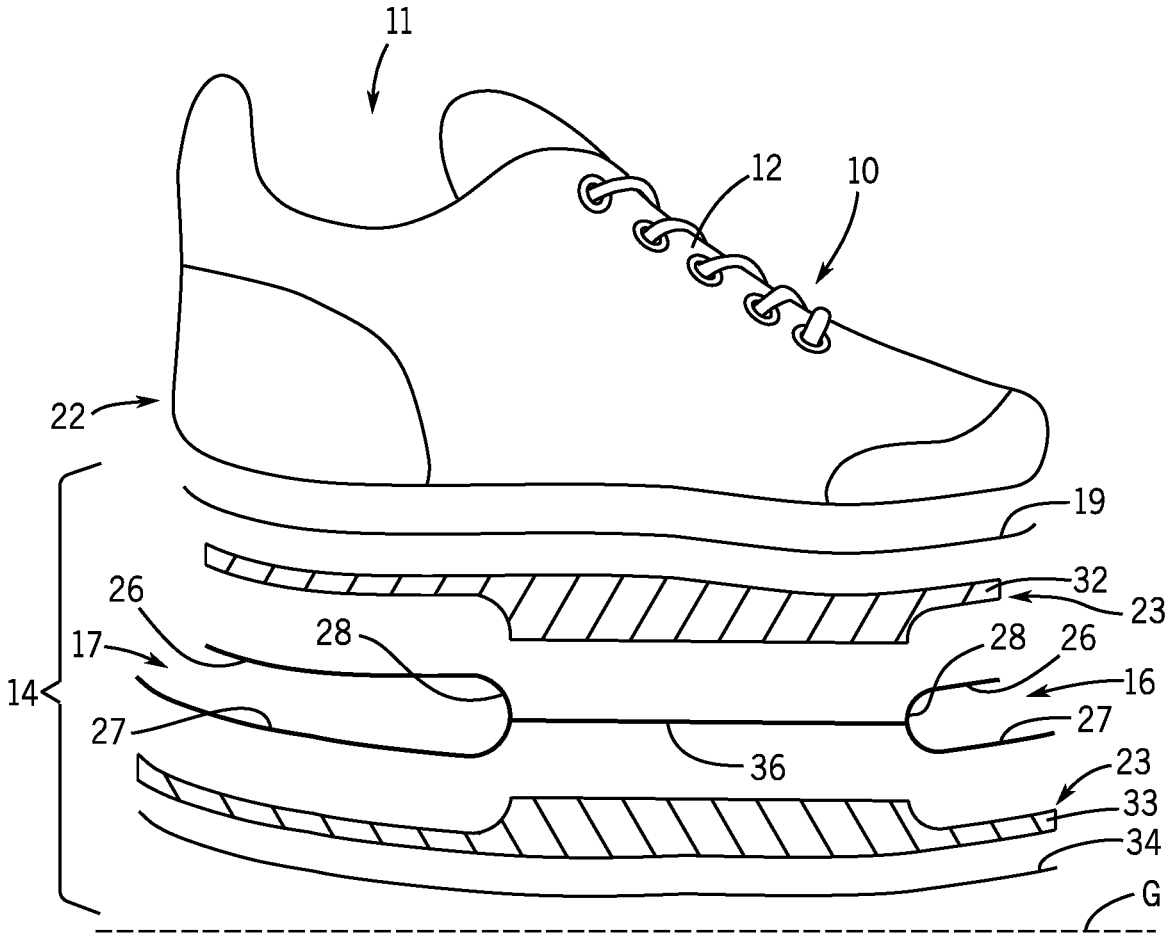
FIG. 5 is an exploded view of another exemplary shoe.

FIG. 5 presents an exploded view of a shoe 10. FIG. 5 includes many features found and described in other figures and the description herein of common components similarly applies between examples. The sole 14 includes a plurality of layers and components such as the insole 19 which may be constructed of rubber and/or polymer foam, which is connected between the shoe upper 12 and the midsole 23. As explained herein the midsole 23 may be constructed of multiple resilient layers 32, 33. The soft, resilient layers may comprise rubber and/or polymer foam and may be separated by a bridge member 36 connecting the sole springs 16, 17. The outsole 15 is secured to the lower layer 33 of the midsole 23. It will be recognized that the insole 19, the midsole 23, and the outsole 15 may be formed of any suitable material such as rubber, foam, and plastic. These components of the sole 14 are bonded to each other with adhesive or are heat-welded to each other. As depicted in FIG. 5, a bridge member 36 extends through the midsole 23 between the resilient layers 32, 33 to connect the sole springs 16, 17 to each other. While one example may have the bridge member 36 separate the resilient layers 32, 33, in other examples, the bridge member 36 bay be narrower in the width dimension than the sole 14 and thus the bridge member may be surrounded or otherwise embedded within the midsole 23.

Figure 6:
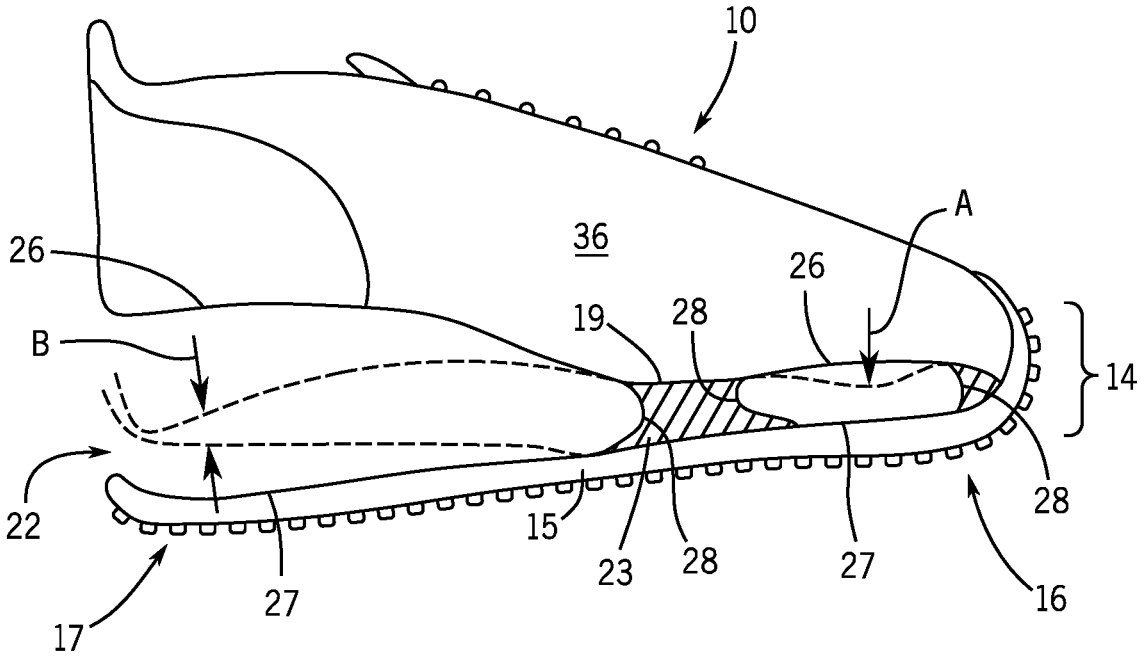
FIG. 6 is side view of another exemplary shoe.

FIG. 6 depicts another example of a shoe 10. The font sole spring 16 includes a second spring end 28B opposite the first spring end 28A. The first and second spring ends are configured second spring end 28B This provides a closed cell sole spring 16 in which the legs 26, 27 are joined to each other at both ends with opposed spring ends 28. The front sole spring 16 is surrounded by the sole 14. In an example, the front sole spring 16 may be surrounded by the midsole 23, while in other examples, the legs 26, 27 may be in contact with the respective insole 19 and the outsole 15. While the shoe 10 is depicted with the sole spring 16 laterally open to the sides of the shoe 10, other examples may enclose sole spring from this direction as well, for example within the midsole 23.

The shoe 10 of FIG. 6 further extends the rear sole spring 17 interior of the shoe to a location proximate the wearer's arch or instep. That is, the spring end 28 of the rear sole spring 17 is positioned near the midpoint of the foot, and may be forward of the foot midpoint. In use, the front sole spring 16 compresses under the weight of the user (see arrow A) as the user transitions from the stance to the toe-off phases. The weight of the user (arrow A) causes the upper leg 26 of the front sole spring 16 to move toward the lower leg 27 (see dashed line) and thereby store energy therein. As the user then pushes off the ground G, the front sole spring 16 returns the stored energy and the user experiences that returned force to reduce the effort needed to lift the shoe 10 off the ground G, or to increase the total force by which the user pushes away from the ground.

The rear sole spring 17 in the exemplary shoe 10 of FIG. 6 operates similarly to the rear sole springs 17 as previously described. However, with the increased length of the legs 26, 27 of the rear sole spring can store additional energy and tends to store that energy later into the heel strike phase and similarly return that energy later in the stance phase and transition into the the toe-off stage.

Figure 7:
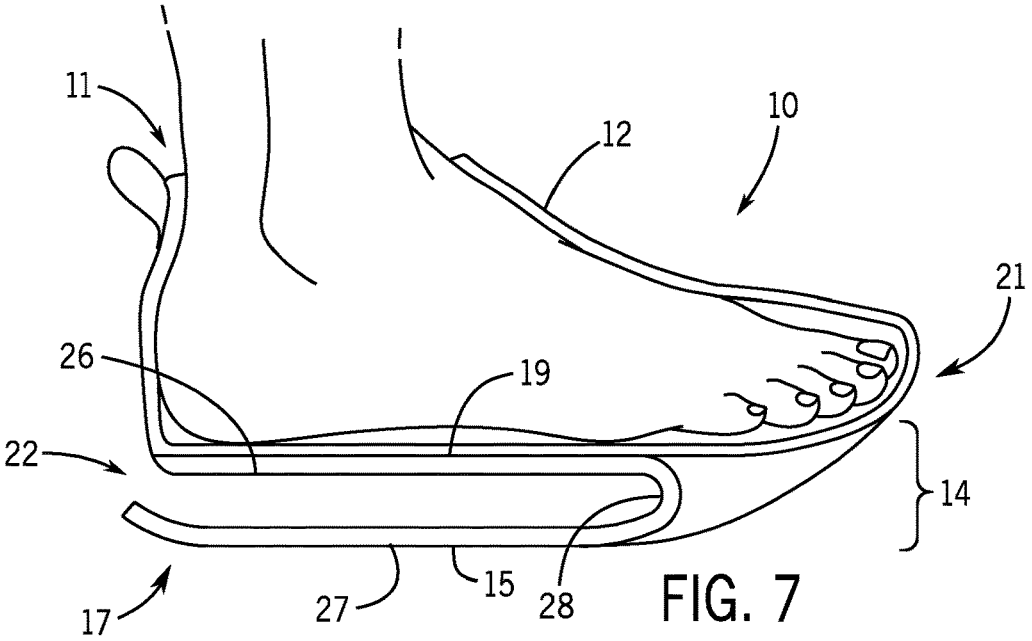
FIGS. 7-12 are side views of other exemplary shoes.
Figure 8:
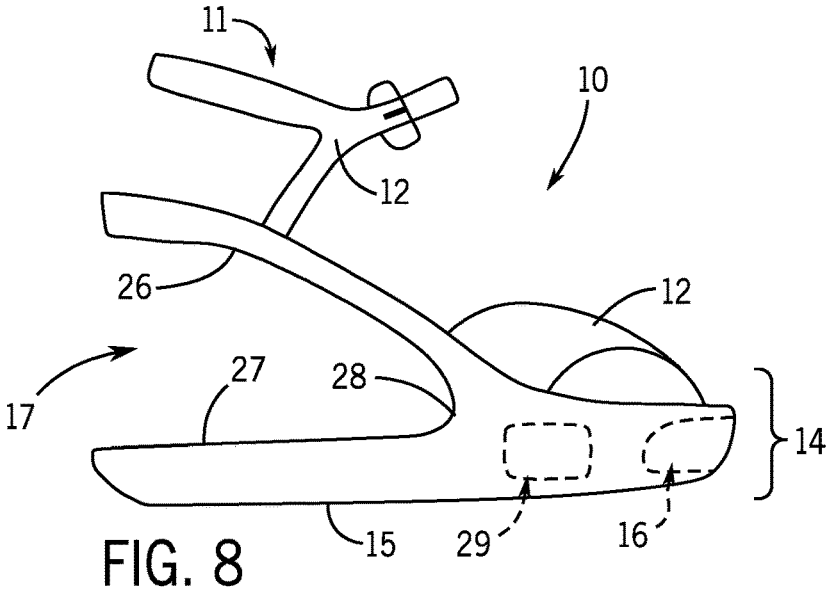
Figure 9:
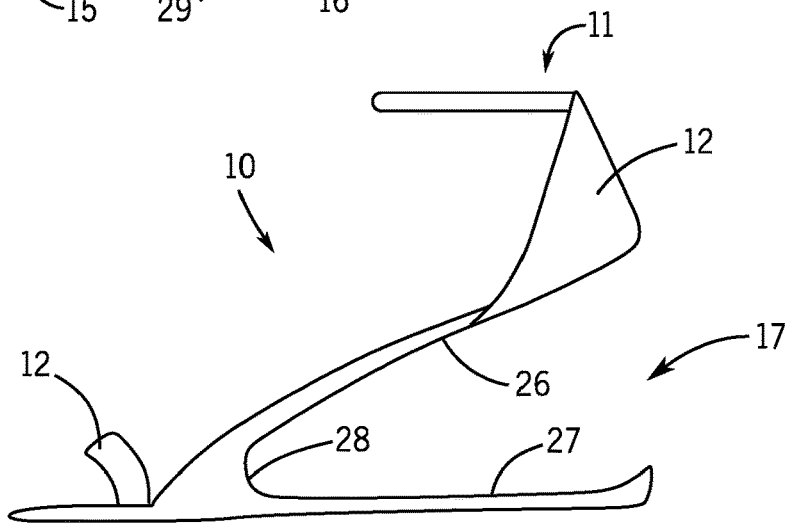
Figure 10:
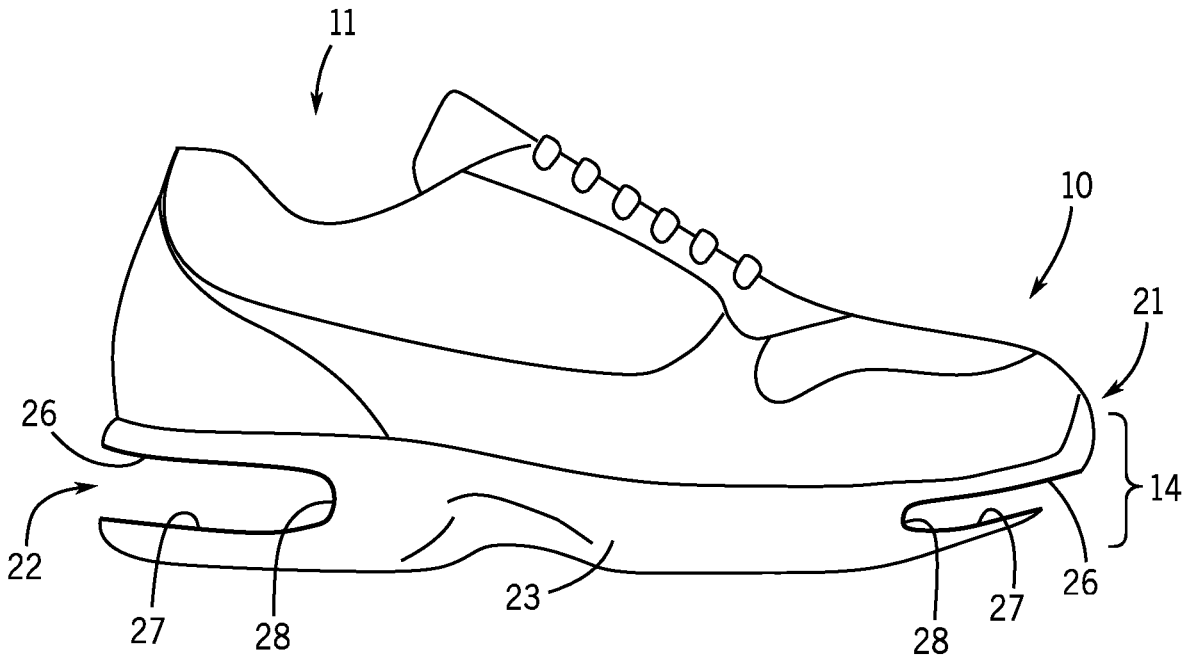
Figure 11:
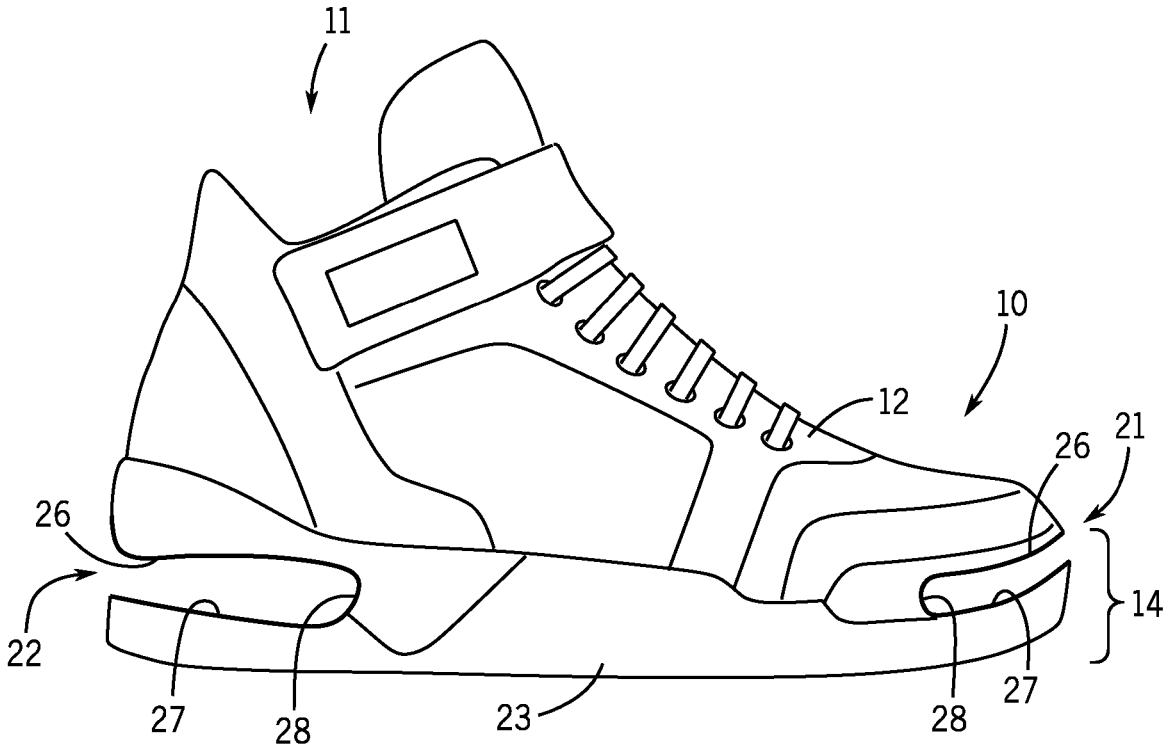

FIGS. 7-12 depict further examples of shoes 10 according to the present disclosure. Specifically, FIG. 7 depicts an athletic shoe, FIG. 8 depicts a high-heel sandal, and FIG. 9 depicts a dress shoe with an elevated heel. The shoes 10 depicted in these Figures include the rear sole spring 17. Note that FIG. 8 depicts the front toe spring 16 and a middle sole spring 29 (described further herein) in dashed lines. Note that FIG. 7 depicts a portion of the shoe upper 12 "cut-away" to expose the foot of the user in the shoe upper 12. FIG. 10 depicts a running shoe and FIG. 11 depicts a basketball shoe.

Figure 12:
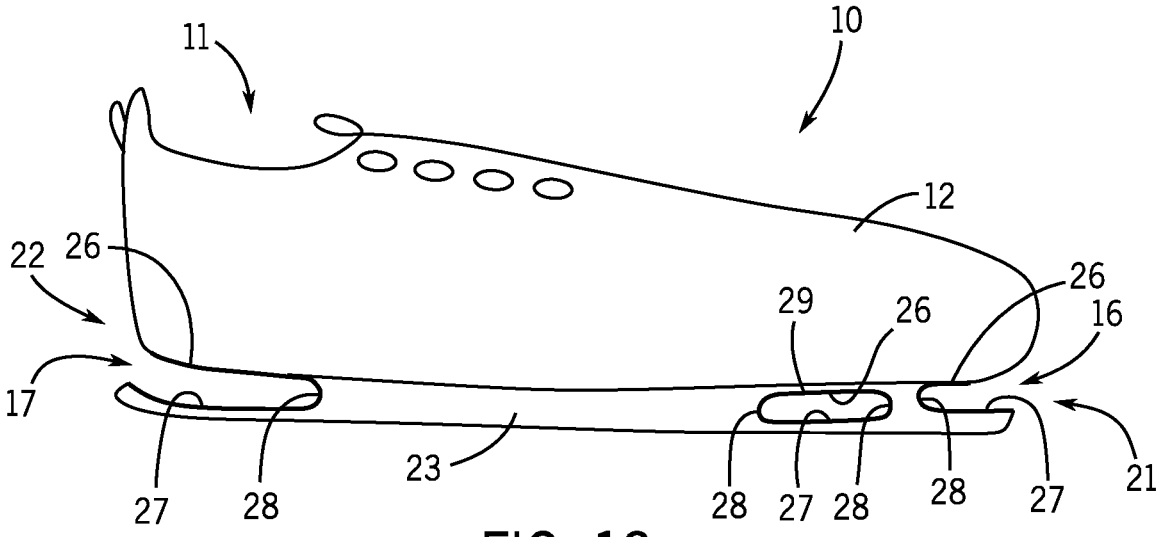
Figure 13:
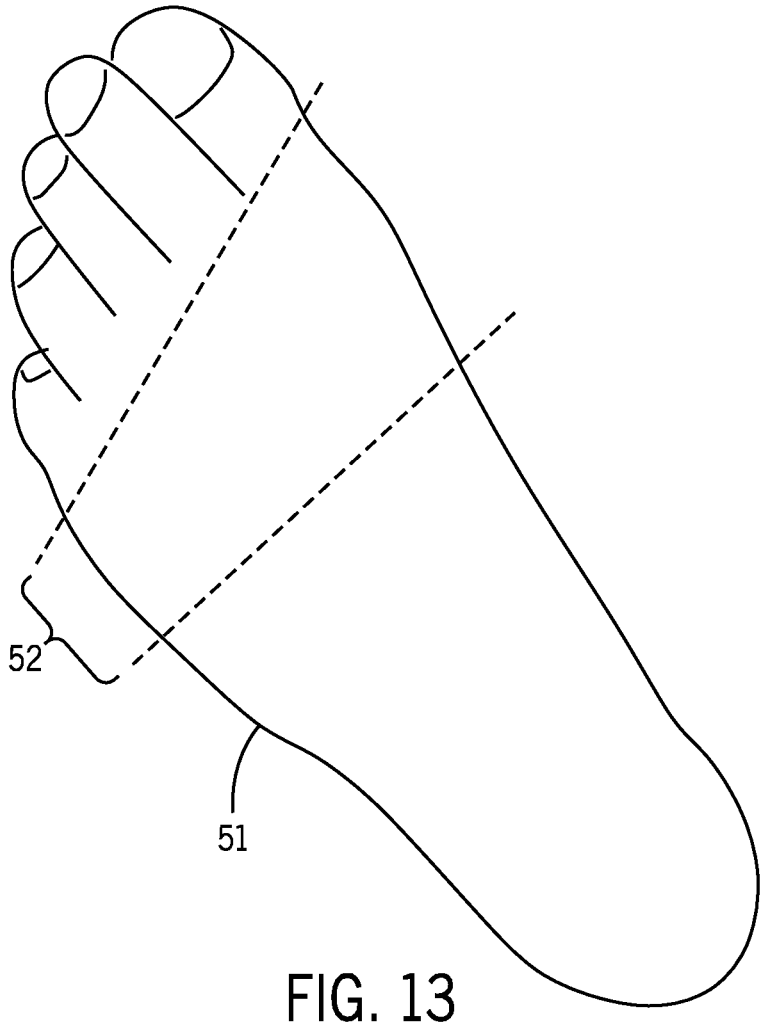
FIG. 13 is a bottom-up plan view of a foot.

FIG. 12 depicts another exemplary shoe 10 according to the present disclosure. The shoe 10 includes the rear sole spring 17, the front sole spring 16, and an additional middle sole spring 29. The middle sole spring 29 is in the sole 14 between the front and rear sole springs 16, 17, and in one example, the middle sole spring 29 at near the metatarsophalangeal (MTP) joints, commonly known as the "ball" of the foot. This is exemplarily depicted as zone 52 in FIG. 13. The middle sole spring 29 may be similarly constructed to any of the sole springs as previously described. In FIG. 12, the middle sole spring 29 is of a closed cell configuration as described above, while the front sole spring 16 and the rear sole spring 17 are of the open or cantilevered configuration described above.

FIGS. 14-15 depict an exemplary shoe 10 with an exemplary embodiment of another sole spring 45. This sole spring 45 is not in the sole 14, and instead the sole spring 45 extends from the outsole 15 of the sole 14. The sole spring 45 is positioned relative to the MTP joint and the toes the foot. This exemplary embodiment of the sole spring 45 and/or the shoe 10 is advantageously used in medical applications such as medical rehabilitation and leg strength training.

The sole spring 45 has a first leg 46 near the shoe upper 12 and a second leg 47 spaced apart from the first leg 46. A joining member 48 connects the first leg 46 to the second leg 47. FIG. 15 depicts enlarged views of the sole spring 45 in an uncompressed position (see arrow 49A) and a compressed position (see arrow 49B). In the uncompressed position 49A, a space or a gap 81 is defined between the first leg 46 and the second leg 47. That is, in the uncompressed position 49A, the end 50 of the second leg 47 is spaced apart from the first leg 46 at a first distance D1. When the user places their weight on or near the ball of the foot (see arrow V that represents the weight of the user acting on the sole spring 45), the first leg 46 and the second leg 47 move toward each other and the sole spring 45 moves into the compressed position 49B. When in the compressed position 49B, the distance between the end 50 of the second leg 47 and the first leg 46 is reduced to a second distance D2 that is less than the first distance D1 (e.g., the first distance D1 is 10.0 millimeters and the second distance D2 is 2.0 millimeters). Also, the middle portions of the first leg 46 and the second leg 47 may also deform and thereby move toward each other. The legs 46, 47 store energy as they flex and deform, and the energy is transferred back to the user (see arrow X1) when the user begins to lift their foot off the ground G. As such, the legs 26, 27 move away from the each other and the sole spring 45 moves back into the uncompressed position 49A.

FIGS. 16-21 depict examples of shoes 10 and sole springs 16, 17, 29 which are ach provided by interchangeable or replaceable sole spring inserts 90. That is, the exemplary shoes 10 in FIGS. 16-21 include one or more the sole springs 16, 17, 29 that include one or more of a series of spring inserts 90 that can be connected and disconnected from the sole 14 of the shoe 10 and replaced with different, spring inserts 90. The spring inserts 90 may be interchangeable and/or replaceable with spring inserts 90 that possess different mechanical properties. For example these mechanical properties may favor impact absorption, while other inserts may exhibit greater return to force during push-off and lift of the foot. In other examples, the inserts may be tuned for performance with users of different weights or gaits. The spring insert 90 shown in FIGS. 16-17 includes a first leg 96, a second leg 97, and a joining member 98 connecting the first leg 96 to the second leg 97. The sole 14 is connected to the shoe upper 12, and the sole 14 has one or more cavities 14A, 14B that are configured to receive the removable spring inserts 90. The cavity 14A near the toe end 21 extends into the sole 14 or is defined by the sole 14. The cavity 14A provides a toe opening 116 in the sole 14. The cavity 14B near the heel end 22 extends into the sole 14 or is defined by the sole 14. The cavity 14B provides a heel opening 117 in the sole 14.

One or more prongs 112 extend into the cavities 14A, 14B to retain the respective spring inserts 90 in the cavities 14A, 14B. That is, the prongs 112 permit movement of the spring inserts 90 into the cavities 14A, 14B and prevent or resist inadvertent movement of the spring inserts 90 out of the cavities 14A, 14B. Insertion and removal of the spring inserts 90 from the cavities 14A, 14B is further described herein below.

Figure 16:
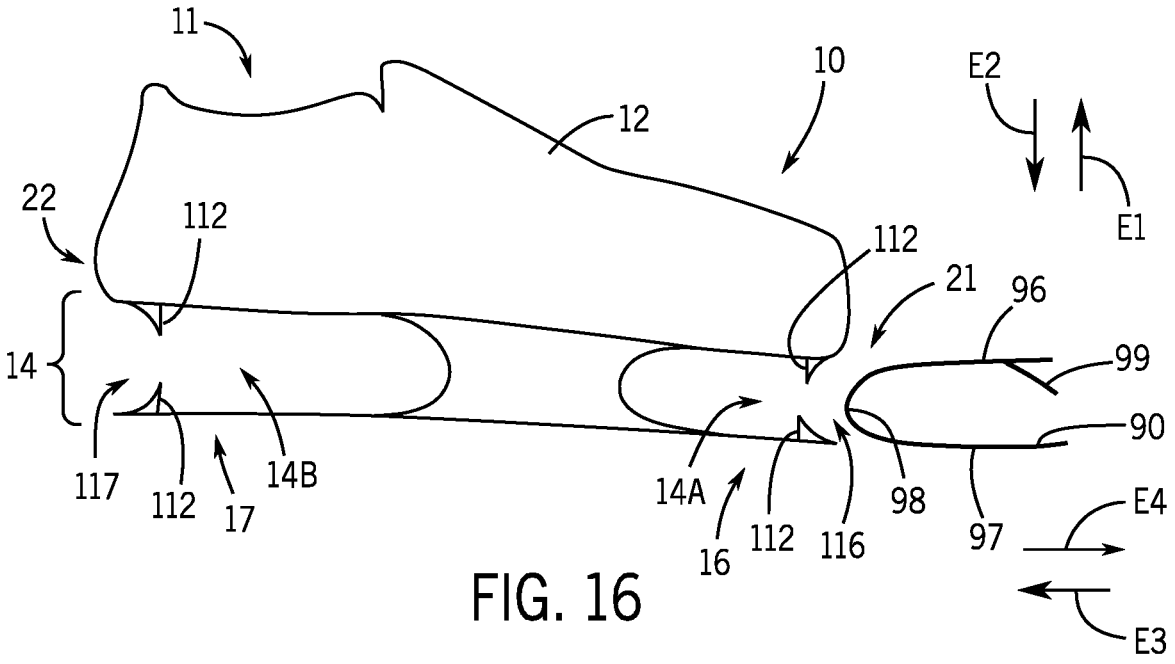
FIG. 16 is a side view of another exemplary shoe.
Figure 17:
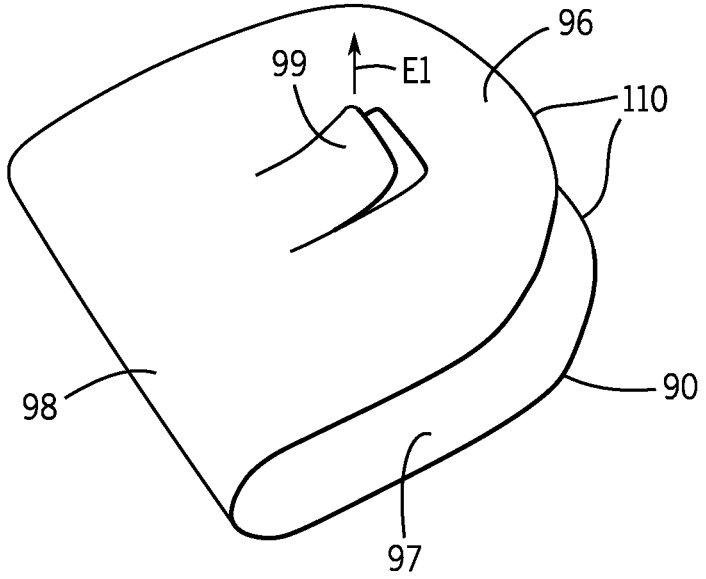
FIG. 17 is a perspective view of an exemplary embodiment of a removable sole spring.

Each leg 96, 97 has an end surface 110, and the first leg 96 has a flexible retention tab 99 that normally extends away from the first leg 96 in a first direction E1. Note that FIG. 17 depicts the retention tab 99 in an extended position and FIG. 16 depicts the retention tab 99 in a recessed position. The user can move the retention tab 99 from the extended position to the recessed position by applying a force (e.g., pushing or pulling) to the retention tab 99 in a second direction E2. In other examples, the retention tab 99 moves toward the recessed position as the spring insert 90 moves into the cavity 14A. That is, as the user moves the spring insert 90 in direction E3 into cavity 14A, the prongs 112, the bottom of the shoe upper 12, and/or an upper layer of the sole 14 engage the retention tab 99 and force the retention tab 99 in direction E2.

Movement of the spring insert 90 in direction E3 into the cavity 14A causes the prongs 112 to act on and flex the legs 96, 97 toward each other. Note that the legs 96, 97 and/or the prongs 112 may elastically deform as the spring insert 90 moves into the cavity 14A. Once the end surfaces 110 of the legs 96, 97 move past the prongs 112, the leg 96, 97 seat behind the prongs 112. The legs 96, 97 and/or the prongs 112 may also flex back to original, un-flexed or uncompressed positions once the legs 96, 97 seat behind the prongs 112. The retention tab 99 also flexes back toward the extended position, and the retention tab 99 prevents the spring insert 90 from inadvertently sliding toward the toe end 21 in direction E4.

To remove the spring insert 90 from the cavity 14A, the user pulls the retaining tab 99 in direction E2 such that the retaining tab 99 is in the recessed position and the user pulls the spring insert 90 in direction E4 out of the cavity 14A. Note that the shape of the retention tab 99 can vary (e.g., the retention tab 99 has a rectangular shape, but other circular, ellipsoid, or polygonal shapes may be used). A person of ordinary skill in the art will recognize that the features described herein above with respect to the spring insert 90 at the toe end 21 may be repeated to thereby insert a second spring insert 90 into the cavity 14A near the heel end 22. Note that in this application, some of the directions noted above with respect to first spring insert 90 and the cavity 14B near the toe end 21 will be mirrored or reversed when the user moves the second spring insert 90 into the cavity 14B near the heel end 22. A person of ordinary skill in the art will also recognize that in some examples the spring insert 90 has more than one retention tab 99.

Figure 18:
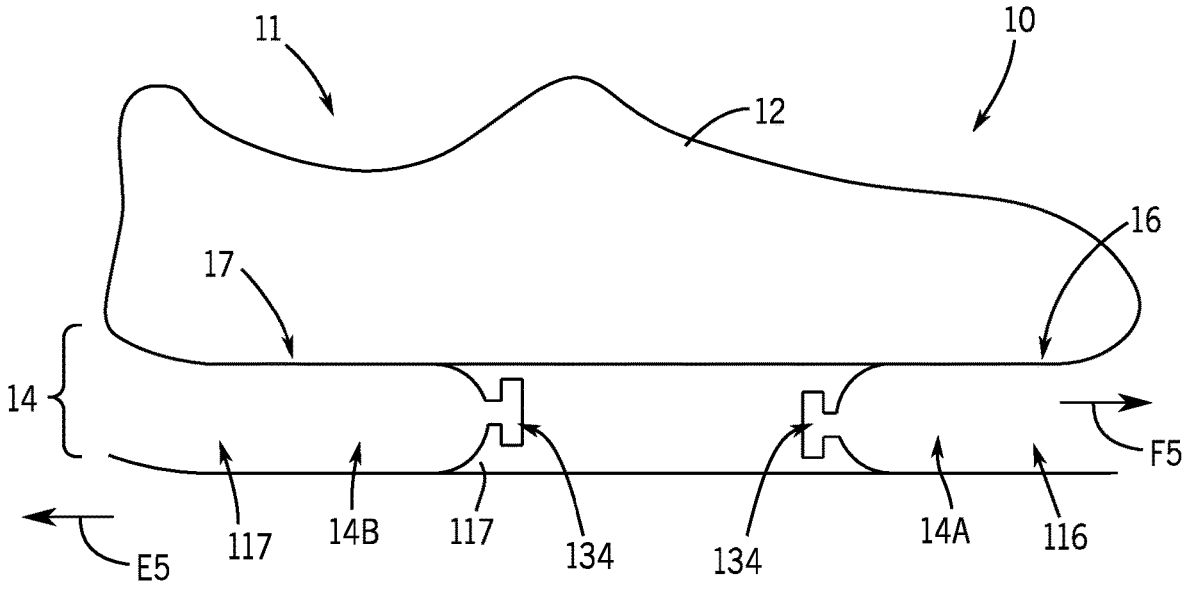
FIG. 18 is a side view of another exemplary shoe.
Figure 19:
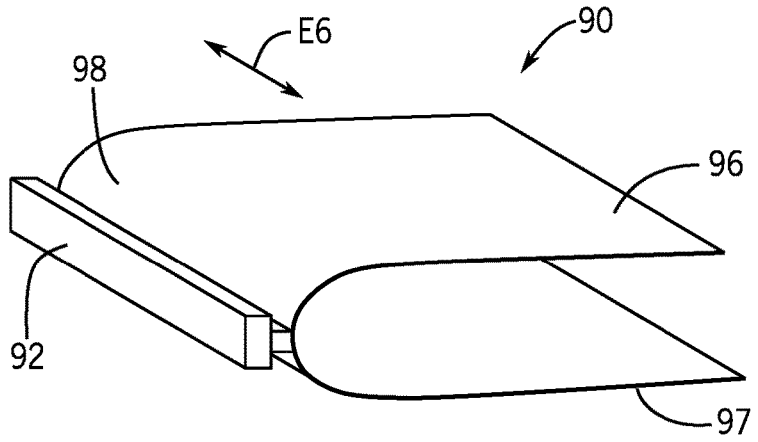
FIG. 19 is a perspective view of another exemplary embodiment of a removable sole spring.

FIGS. 18-19 depict another example an interchangeable or replaceable spring insert 90. FIG. 19 depicts the spring insert 90 with a key member 92 extending from the joining member 98 that connects the legs 96, 97 of the spring insert 90. The shape of the key member 92 can vary, and in the illustrated embodiment, the key member 92 is T-shaped. FIG. 18 depicts one or more keyways 134 in the sole 14, and the keyways 134 receive the key members 92 of the spring inserts 90 when the user positions the spring inserts 90 into the cavities 14A, 14B. Note that the shape of the keyways 134 correspond to the shape of the key members 92.

A user positions the spring insert 90 into the cavity 14A, 14B by placing the spring insert 90 along the side of the sole 14 such that the key member 92 aligns with the keyway 134. The user then moves (e.g., pushes or pulls) the spring insert 90 into the cavity 14A, 14B by pushing the spring insert 90 through the opening 116, 117 in the sole 14 toward the opposite side of the sole 14 (e.g., movement in a direction from an exterior side of the sole 14 toward an opposite interior side of the sole 14). Accordingly, the key member 92 slides in the keyway 134 and the legs 96, 97 slide in the cavity 14A. The key member 92 prevents the spring insert 90 from moving in a lengthwise direction E5 out of the cavity 14A. Note that friction between the key member 92 and the keyway 134 retains the spring insert 90 in the cavity 14A, 14B and prevents the spring insert 90 from inadvertently moving out of the cavity 14A, 14B through the openings 116, 117 in the sole 14. In one exemplary embodiment, the surfaces of the sole 14 defining the keyway 134 are roughened or have abrasive surface patterns (e.g. cross-hatching patterns) that create friction between the keyway 134 and the key member 92. Note that FIG. 18 depicts the keyways 134 oriented in directions toward each other and the cavities 14A, 14B (and the sole spring 16, 17) are oriented in directions away from each other and out the ends 21, 22 of the shoe 10.

To remove the spring insert 90 from the cavity 14A, 14B, the user applies a force in a direction from one side of the sole 14 toward the opposite side of the sole 14 to thereby push or pull the spring insert 90 out of the cavity 14A, 14B and slide the key member 92 out of the keyway 134. (e.g., see arrow E6 on FIG. 19 that depicts movement of the spring insert 90 in a side-to-side direction relative to the sole 14 of the shoe 10).

Figure 20:
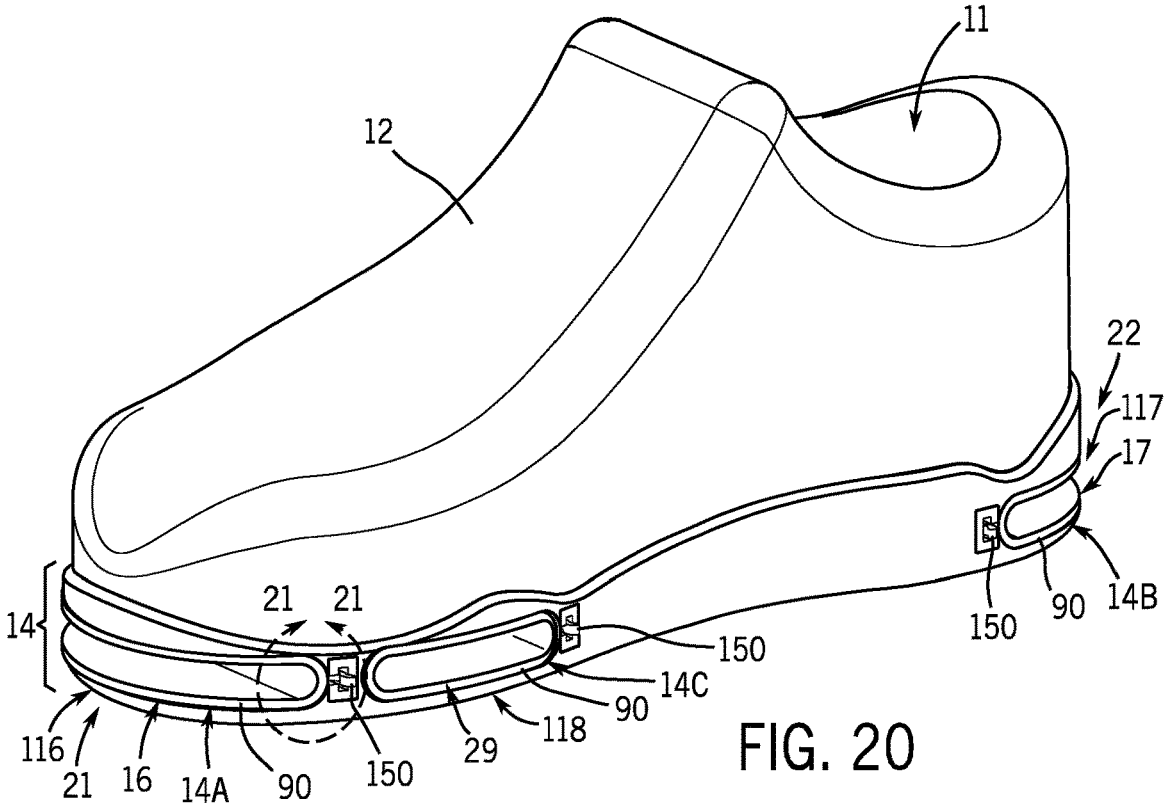
FIG. 20 is a perspective view of another exemplary shoe with exemplary embodiments of removable sole springs.
Figure 21:
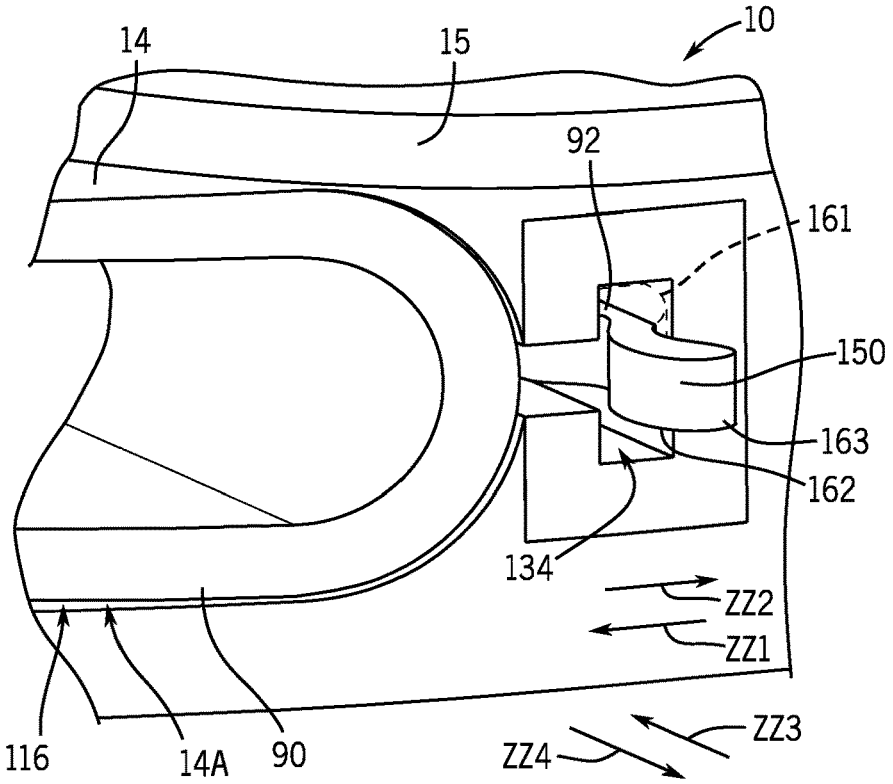
FIG. 21 is an enlarged view of the shoe within line 21-21 on FIG. 20.

FIGS. 20-21 depict another example of an interchangeable or replaceable spring insert 90. The spring insert 90 is similar to that as depicted in FIGS. 18-19, but further includes a tab 150 extending from the key member 92. The sole 14 has a recess 161 (see dashed lines on FIG. 21) that receives the tab 150 when the spring insert 90 is in the cavity 14A and the key member 92 is in the keyway 134. To position the spring insert 90 into the cavity 14A, the user aligns the key member 92 with the keyway 134 and pushes the spring insert 90 through the toe opening 116 in the sole 14 toward the opposite side of the sole 14 (see arrow ZZ3). The tab 150 enters the keyway 134 and flexes in a first direction (see arrow ZZ1). Further movement of the spring insert 90 into the cavity 14A causes the tab 150 to slide along a surface 162 of the sole 14 that defines the keyway 134 until the tab 150 elastically flexes in a second direction (see arrow ZZ2) into the recess 161. Once in the tab 150 is in the recess 161, the tab 150 prevents further movement of the spring insert 90 in the cavity 14A and out of the cavity 14A. That is, when the tab 150 is in the recess 161, the spring insert 90 is "locked" in the cavity 14A.

To the remove the spring insert 90 from the cavity 14A, the user moves a lever 163 of the tab 150 in the first direction (see arrow ZZ1) such that the tab 150 moves in the first direction out of the recess 161 (see arrow ZZ1). The user then applies a pushing force or a pulling force (see arrows ZZ3 and ZZ4) to the spring insert 90 such that the spring insert 90 slides out of the cavity 14A through the toe opening 116. In FIG. 20, the third sole spring 29 has a removable spring insert 90 that removably slides into a cavity 14C that is between the other cavities 14A, 14B in the sole 14. The cavity 14C provides a pair of openings 118 in the sole 14 (note that one of the openings 118 is not depicted in FIG. 20).

Figure 22:
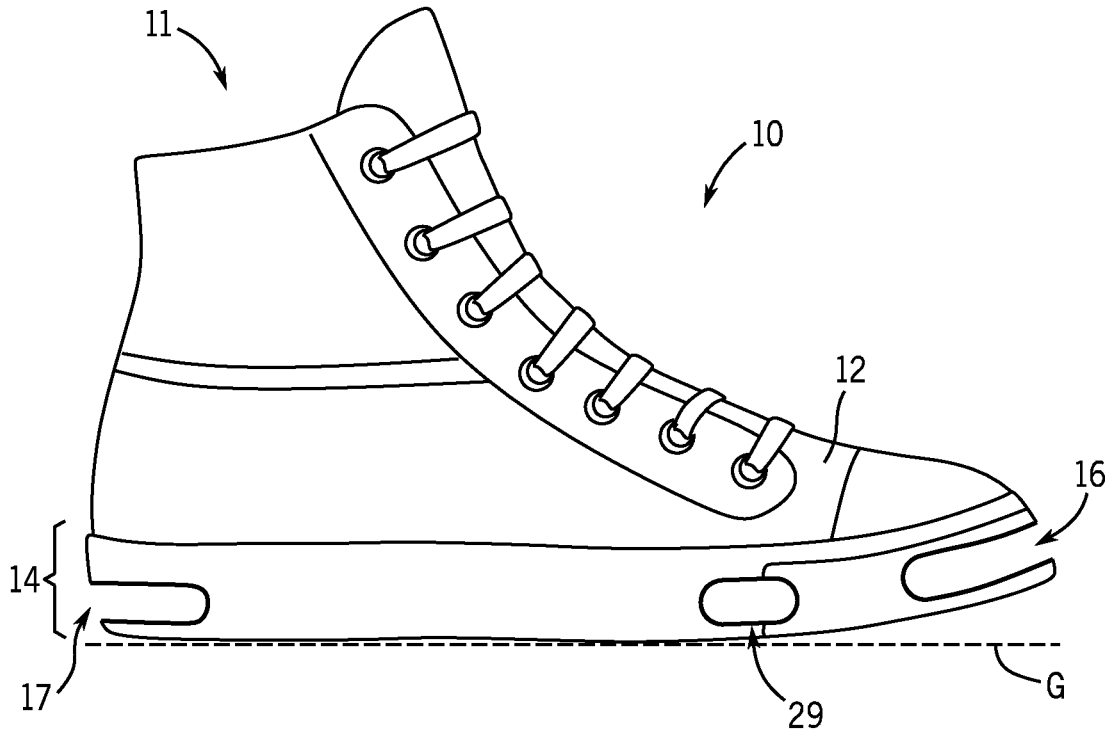
FIG. 22 is a side view of another exemplary shoe.

FIG. 22 depicts another configuration of a shoe 10 similar to that as described above with respect to FIGS. 12 and/or FIG. 20. Note that the middle sole spring 29 is in a cavity (not shown) in the sole 14 and spaced apart from the cavities 14A at the toe end 21 and 14B heel end 22.

FIG. 23 is a top-down plan view of the feet of the user in the shoes 10 (e.g., a right shoe and a left shoe). Note that the outer extents of the shoes 10 are depicted in dash-dot-dash lines. The sole springs 16, 17, 29 (depicted in dash-dash lines in FIG. 23) are spaced apart within the sole 14 of the shoes 10. Specifically, the front sole spring 16 is located in the toe end 21 and the rear sole spring 17 is located in the heel end 22. The front sole spring 16 defines the toe end 21 and the rear sole spring 17 defines the heel end 22. The middle sole spring 29 is between the toe end 21 and the heel end 22 at an MTP zone 144 in an expected location of the MTP joint of the foot of the user. The sole 14 of the shoe 10 has a length L1 in the longitudinal dimension L, between the toe end 21 and the heel end 22. A midpoint MP is defined half-way between the outer extent of the toe end 21 and the outer extent of the heel end 22 along the length L1. The MTP zone 144 of is located towards the midpoint MP from the toe end 21 of the shoe 10 in an expected location of the MTP joint of the foot of the user. The MTP zone 144 coincides with the region of greatest width of the sole 14 of the shoe 10 in the lateral dimension T. The middle sole spring 29 is located in this MTP zone 144 between the toe end 21/front sole spring 16 and the midpoint MP. A narrowest portion of the sole 14 of the shoe 10 in the lateral dimension T is located at an instep 146 between the midpoint MP and the rear sole spring 17 and heel end 22.

Figure 24:
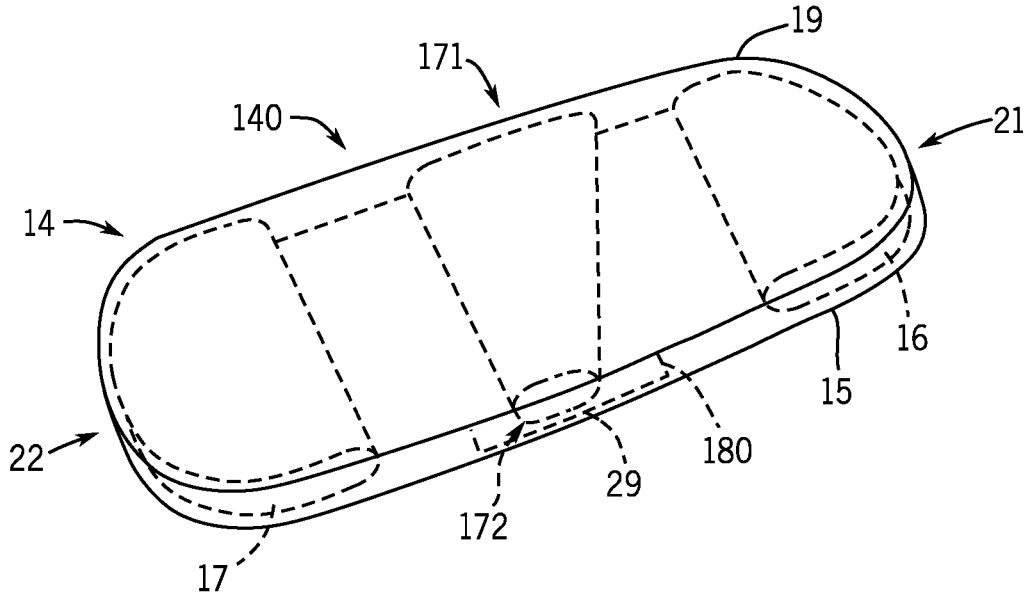

FIG. 24 is a perspective view of the sole 14 of the right shoe of FIG. 23. Note that FIG. 24 depicts the insole and the outsole in dashed lines and does not include the shoe upper in order to provide an improved view of the sole springs 16, 17, 29 therein. The midsole is located between the insole and the outsole as described above. It will further noticed that the middle sole spring 29 is in the configuration of a closed cell spring, while the front sole spring 16 and the rear sole spring 17 are in the form of cantilever springs, all as previously described. However, it will be recognized that in other examples, the front sole spring 16 and/or the rear sole spring 17 may be constructed as closed cell springs as well.

It will also be recognized that the middle sole spring 29 is shaped to taper in a manner that matches the curve of a foot and specifically a general profile of the MTP joint. In this manner, the middle sole spring 29 is larger in diameter, as well as in length, at the medial side 140, and smaller in diameter and length at the lateral side 141 of the sole spring 29, as well as the shoe 10 itself. As further exemplified in FIG. 24, the sole 14 may extend in one or both of the longitudinal dimension and/or the lateral dimension beyond at least one or more of the sole springs 16, 17, 29. That is in examples, the midsole may extend laterally and/or longitudinally around one or more sole springs 16, 17, 29, such that the one or more sole springs 16, 17, 29 are located within the midsole. In a still further example, a shroud 180, optionally shown as a portion across the middle sole spring 29 that is constructed of plastic, polymer, polymer foam, rubber, fabric, or other material extends across at least a portion of the midsole between the insole 19 and the outsole 15 exterior of one or more of the sole springs 16, 17, 29 to conceal and/or protect the sole springs 16, 17, 29. In an example wherein one or more of the sole springs 16, 17, 29 are removable, such a shroud 180 may optionally conceal one or more of the sole springs 16, 17, 29 while in use within the shoe 10, but enable access to the sole springs 16, 17, 29 for removal and/or replacement.

Figure 25A:
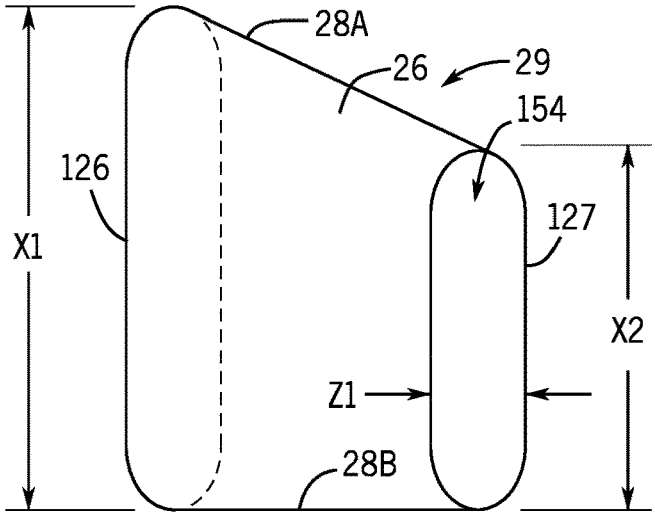
FIGS. 25A-25C are perspective views of an exemplary embodiment of a sole spring in different positions.
Figure 25B:
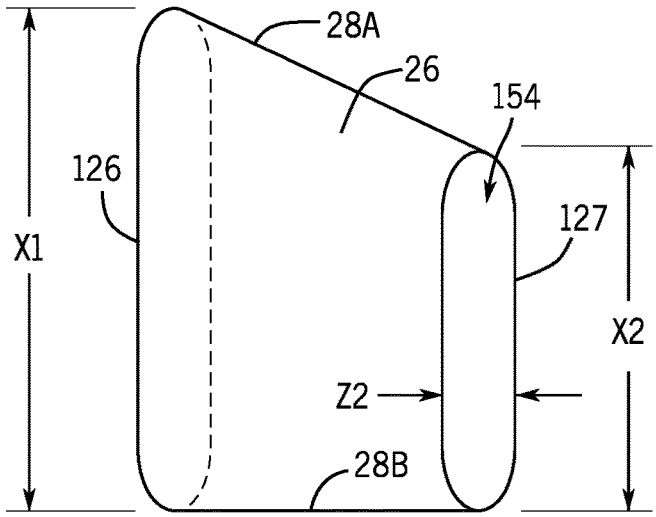
Figure 25C:
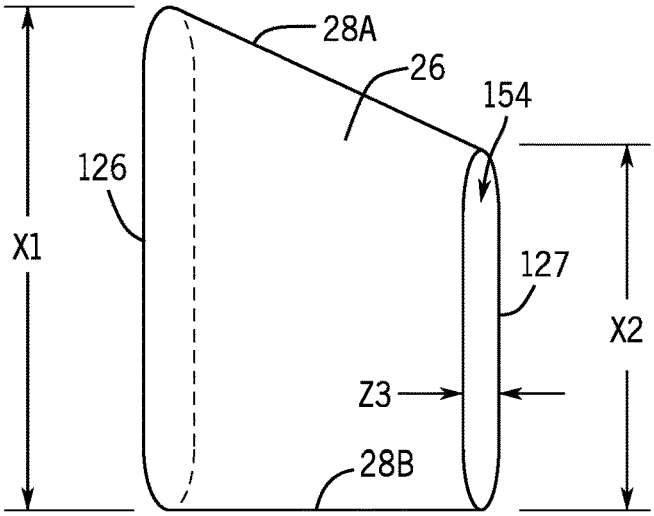

FIGS. 25A-C depict different positions or states of the middle sole spring 29 as the user uses the shoe 10. Referring to FIG. 25A, the middle sole spring 29 is depicted in an uncompressed position such as when the user is not wearing the shoe 10. The middle sole spring 29 has a first spring end 28A, an opposite second spring end 28B, a leg 26 connected to an opposite leg 27 by the respective spring ends 28A, 28B. The first spring end 28A is orientated toward the toe end 21 (FIG. 24), and the second spring end 28B is orientated toward the heel end 22 (FIG. 24). The legs 26, 27 are generally planar and extend parallel to each other, when the middle sole spring 29 is uncompressed. The middle sole spring 29 extends between the medial and lateral sides 140, 141 of the shoe 10. In an example, the middle sole spring 29 is at least partially exposed through the sole 14 and defines a first opening 171 in the sole 14 along the medial side 140 and a second opening 172 in the sole 14 along the lateral side 141. The first opening 171 is larger than the second opening 172.

The middle sole spring 29 tapers in a direction from the medial side 140 to the lateral side 141 of the shoe 10. That is, the first side 126 has a first length X1 (FIG. 23) that is greater than a second length X2 along the second side 127 of the middle sole spring 29. The middle sole spring 29 is advantageously shaped in this manner to thereby cushion the MTP joint of the foot. The tapered shape of the middle sole spring 29 advantageously provides more cushioning and support near the medial side 140 of the shoe 10 than the lateral side 141 of the shoe 10. That is, medial side 140 of the middle sole spring 29 is configured to support the more weight of the user. Furthermore, the tapered shape of the middle sole spring 29 provides better comfort and cushioning to the user.

As noted above, FIG. 25A depicts the middle sole spring 29 in an uncompressed position in which the user is not wearing the shoe 10 or when the shoe 10 does not contact the ground G. As the user moves the shoe 10 into contact with the ground G, the front and rear sole springs 16, 17 begin to compress into the open void 154 between the legs 26, 27, as noted above with respect to the other exemplary embodiments of the sole springs 16, 17. The middle sole spring 29 also compresses as the user moves the shoe 10 into contact with the ground G. As the middle sole spring 29 compresses (e.g., as the user's center of gravity moves forward from the heel strike to the stance phase, the user increasingly places their weight onto the middle sole spring 29), the distance between the legs 26, 27 decreases. FIG. 25A depicts the legs 26, 27 spaced apart from each other at a first distance Z1. As the middle sole spring 29 compresses, the distance between the legs 26, 27 decreases to a second distance Z2 (see FIG. 25B depicts the middle sole spring 29 in a partially compressed position) and further decreases to a third distance Z3 (e.g., FIG. 25C depicts the middle sole spring 29 in a maximum compressed position). As the middle sole spring 29 compresses, the middle sole spring 29 elastically deforms and/or flexes thereby storing energy therein and cushioning the foot of the user. When the user begins to lift the shoe 10 off the ground G, the middle sole spring 29 releases or returns the energy to the foot in a force that increases the total force propelling the user forward and/or reduces the effort necessary to lift the shoe 10 off of the ground G.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A shoe extending from a heel end to a toe end, the shoe comprising:

an upper configured to receive a foot of a user;

a sole comprising an insole connected to the upper and an outsole configured for contact with a support surface, the sole extending from the heel end to the toe end in a longitudinal dimension defining a length of the sole, a midpoint of the sole being halfway between the heel end and the toe end along the length of the sole, and the sole extends in a lateral dimension perpendicular to the longitudinal dimension defining a width of the sole, the sole further comprising an instep between the heel end and the toe end and a metatarsophalangeal (MTP) zone between the midpoint and the toe end; and a plurality of sole springs located in the sole between the insole and the outsole, each sole spring of the plurality of sole springs comprising at least a first leg and a second leg, the first leg and the second leg connected by a spring end, the plurality of sole springs comprising:

a heel sole spring extending into the heel end of the sole in the direction of the instep;

a toe sole spring extending into the toe end in the direction of the instep and terminating prior to the MTP zone; and a middle sole spring located in the MTP zone between the midpoint and the toe sole spring;

wherein the middle sole spring extends in the longitudinal dimension between a first spring end and a second spring end, the middle sole spring extends in the lateral dimension between a medial side of the middle sole spring and a lateral side of the middle sole spring, wherein a first length between the first spring end and the second spring end in the longitudinal dimension at the medial side is greater than a second length between the first spring end and the second spring end in the longitudinal dimension at the lateral side, and the middle sole spring tapers in the longitudinal dimension across the middle sole spring from the medial side to the lateral side;

wherein when the user presses the shoe into contact with the support surface the plurality of sole springs store energy therein with relative movement of the first legs towards the second legs; and wherein when the user moves the shoe away from the support surface the plurality of sole springs release the stored energy by relative movement of the first legs away from the second legs.

2. The shoe of claim 1, further comprising a midsole between the insole and the outsole, wherein the plurality of sole springs are located in the midsole.

3. The shoe of claim 1, wherein the MTP zone is located at a region of maximum sole width.

4. The shoe of claim 1, wherein a portion of the midsole extends exterior of at least one sole spring of the plurality of sole springs in the lateral dimension.

5. The shoe of claim 1, further comprising a shroud extending exterior of the plurality of sole springs in the lateral direction.

6. The shoe of claim 1, wherein the heel sole spring and the toe sole spring each further comprise second spring ends connecting the respective first legs and second legs of the respective heel sole spring and toe sole spring.

7. The shoe of claim 1, wherein the spring end of the heel sole spring is located at a side of the heel sole spring proximate the toe end of the sole and the spring end of the toe sole spring is located at a side of the toe sole spring proximate the heel end of the sole.

8. The shoe of claim 7, wherein the toe sole spring is open towards the toe end of the sole and the heel sole spring is open towards the heel end of the sole.

9. The shoe of claim 1, wherein at least one sole spring of the plurality of sole springs is removable from the sole.

10. The shoe of claim 1, wherein the sole further comprises a heel cavity, a toe cavity, and a middle cavity located between heel cavity and the toe cavity located between the insole and the outsole, and wherein the heel sole spring, toe sole spring, and the middle sole spring are configured to be removably secured within the respective heel cavity, toe cavity, and middle cavity.

11. The shoe of claim 1, wherein the first leg and the second leg extend parallel to each other.

12. The shoe of claim 10, further comprising:

a keyway extending from the cavity into the midsole; and a key member extending from the spring end of the sole spring, the key member configured for releasable engagement with the keyway to secure the sole spring within the cavity.

13. The shoe according to claim 12, further comprising:

a midsole between the insole and the outsole;

a recess defined into the midsole; and a tab extending from the key member, wherein the tab is resiliently received within the recess to prevent lateral movement of the key member in the keyway.

14. The shoe of claim 1, as the middle sole spring tapers in the longitudinal dimension across the lateral dimension, the second spring end angles towards the heel spring away from the toe spring.

* * * * *